US012337367B2

(12) United States Patent
Del Fabro

(10) Patent No.: US 12,337,367 B2
(45) Date of Patent: Jun. 24, 2025

(54) APPARATUS AND METHOD FOR WORKING OBLONG METAL PRODUCTS

(71) Applicant: M.E.P. MACCHINE ELETTRONICHE PIEGATRICI S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 72 days.

(21) Appl. No.: 18/008,028

(22) PCT Filed: Jun. 3, 2021

(86) PCT No.: PCT/IT2021/050171
§ 371 (c)(1),
(2) Date: Dec. 2, 2022

(87) PCT Pub. No.: WO2021/245715
PCT Pub. Date: Dec. 9, 2021

(65) Prior Publication Data

US 2023/0249237 A1 Aug. 10, 2023

(30) Foreign Application Priority Data

Jun. 4, 2020 (IT) ..... 102020000013174

(51) Int. Cl.
*B21C 23/08* (2006.01)

(52) U.S. Cl.
CPC ..... *B21C 23/08* (2013.01)

(58) Field of Classification Search
CPC ..... B21C 23/01; B21C 23/04; B21C 23/08; B21C 23/212; B21D 11/12; B21D 11/22; B21D 43/285; B21D 43/12; B21D 43/10
See application file for complete search history.

(56) References Cited

U.S. PATENT DOCUMENTS

2018/0221930 A1* 8/2018 Del Fabro ..... B21F 1/006

FOREIGN PATENT DOCUMENTS

| | | | |
|---|---|---|---|
| EP | 506575 | A1 | 9/1992 |
| FR | 2553314 | A1 | 4/1985 |
| WO | 2003045603 | A1 | 6/2003 |
| WO | 2014188332 | A1 | 11/2014 |
| WO | 2019186610 | A1 | 10/2019 |

OTHER PUBLICATIONS

International Search Report and Written Opinion of PCT Appl. No. PCT/IT2021/050171 mail date Sep. 24, 2021, 13 pages.
International Preliminary Report on Patentability for PCT Appl. No. PCT/IT2021/050171 mail date Dec. 15, 2022, 8 pages.

* cited by examiner

*Primary Examiner* — Teresa M Ekiert
(74) *Attorney, Agent, or Firm* — Maine Cernota & Curran

(57) ABSTRACT

Apparatus (10) for working oblong metal products (P), comprising a drawing unit (11) for moving at least one of said metal products (P) in a direction of feed (Z), and a work unit (12) disposed downstream of said drawing unit (11), comprising a work plane (13) with which at least one bending device (14) and at least one cutting device (15) are associated. The present invention also concerns a corresponding method to work said metal products (P).

14 Claims, 4 Drawing Sheets

APPARATUS AND METHOD FOR WORKING OBLONG METAL PRODUCTS

RELATED APPLICATIONS

This application is a national phase application filed under 35 USC § 371 of PCT Application No. PCT/IT2021/050171 with an international filing date of Jun. 3, 2021, which claims priority of IT patent application No. 102020000013174 filed Jun. 4, 2020. Both of these applications are incorporated herein by reference in their entirety for all purposes.

FIELD OF THE INVENTION

The present invention concerns an apparatus and a method for working oblong metal products for the production of finished products such as stirrups and/or shaped pieces, straightened bars, or accessories for the building trade, or other, or similar or comparable products.

BACKGROUND OF THE INVENTION

Apparatuses are known for the production of finished products such as stirrups and/or shaped pieces, straightened bars, or in general structural accessories, more or less complex, for example for the building trade, starting from oblong metal products. To obtain the finished products, the starting product can be a coil or one or more bundles of pre-cut bars.

Known apparatuses generally comprise at least one drawing unit and a work unit disposed downstream of the drawing unit.

Normally the work unit is disposed in a fixed position and comprises, for example, a bending device, while the drawing unit feeds the desired length of metal product that is to be worked toward the work unit, on each occasion and in a controlled manner.

The drawing unit, also disposed in a fixed position, can comprise one or more pairs of opposite rollers, of which at least one roller is motorized to feed the metal product to the work unit. If it is necessary to have a greater control on the drawing of the metal product, the drawing unit can be of the caterpillar type and can comprise one or more pairs of tracks disposed facing each other to define a drawing channel for the metal products.

Between the drawing unit and the work unit there is normally a cutting unit used to define the finished product.

One of the disadvantages of known apparatuses is that it is difficult to carry out a uniform feed of the oblong products, especially if more than one metal product is fed at a time, and even more so if the cross sections of the products are not identical or are deformed.

Another disadvantage, in particular in the case of drawing using tracks, is that in order to ensure the correct feed of the metal product it is necessary to limit the effective length of the workable product. In fact, it is indispensable to always have a length of product gripped that is sufficient to guarantee it is drawn. For this reason, the scraps can have quite considerable lengths and the economic losses related to their non-use can be very large.

There is therefore a need to perfect an apparatus and method for working oblong metal products which can overcome at least one of the disadvantages of the state of the art.

In particular, one purpose of the present invention is to provide an apparatus for working oblong products which is able to limit the length of the scrap of each product as much as possible.

Another purpose of the present invention is to provide an apparatus for working oblong products which is simple and which allows to increase productivity and reduce the unit costs of the finished products made.

Another purpose is to perfect a method for working oblong metal products able to optimize their use by reducing the length of the scrap.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, an apparatus for working oblong metal products, which overcomes the limits of the state of the art and eliminates the defects present therein, comprises:

- a drawing unit for moving at least one of the metal products in a direction of feed,
- a work unit disposed downstream of the drawing unit, comprising a work plane with which at least one bending device and at least one cutting device are associated.

According to one aspect of the present invention, the drawing unit is mobile in the direction of feed toward/away from the work unit.

According to one aspect of the present invention, the work unit is mobile in an operating direction transverse with respect to the direction of feed so as to dispose on each occasion the bending device or the cutting device aligned with the at least one metal product being worked.

According to one aspect of the present invention, the drawing unit is provided with tracks and is associated with gripping means facing toward the work unit. The gripping means comprise at least one gripper that has an elongated profile in the direction of feed and is able to hold the at least one metal product at least during the working of a final portion thereof.

This solution allows to optimize the length of the metal products to be worked in order to obtain a greater number of finished products. In addition, the length of the scrap of the last finished product is minimized thanks to the movement of the drawing unit in the direction of feed, coordinated with the action of the gripping means and the cutting device.

According to one aspect of the present invention, the cutting device comprises at least one shears and means with a pinching function, hereafter also called gripper.

In a first solution, the means with a pinching function are the shears themselves.

In another solution, the means with a pinching function are different from the shears.

In yet another solution, the means with a pinching function consist partly of at least part of the shears and are partly different from the shears.

According to one aspect of the present invention, the cutting device is retractably mobile between a retracted position and a position protruding with respect to the work plane and is operative to perform the gripping and/or cutting of the at least one metal product being worked.

According to one aspect of the present invention, the protruding position in which the means with a pinching function and the shears are located is adjustable with respect to the work plane.

In accordance with some embodiments, there is provided a method to work oblong metal products performed with the apparatus as above. The method provides at least:

- a first step, in which the drawing unit moves backward in the direction of feed, away from the work unit, to pick up at least one waiting metal product,
- a second step, in which the drawing unit advances in the direction of feed toward the work unit to reach a position where the at least one metal product is worked, and in which the work unit is moved in the operating direction so that the bending device is aligned with the at least one metal product,
- a third step, in which the drawing unit, remaining stationary in the work position, makes the at least one metal product advance by means of the tracks toward the bending device which performs the workings provided in order to make at least one finished product,
- a fourth step, in which the work unit is moved in the operating direction so that the cutting device is aligned with the at least one metal product being worked in order to cut and partly move the at least one first finished product away from the at least one metal product being worked.

According to one aspect of the present invention, when the length of the at least one metal product being worked is not sufficient to be drawn by the tracks, the method provides a repositioning step in which the work unit is moved in the operating direction so that the cutting device is aligned with the at least one metal product being worked in order to hold it, the drawing unit moves backward in the direction of feed, away from the work unit, so that the tail end of the at least one metal product is taken in correspondence with the gripping means which are tightened in order to hold the at least one metal product.

According to another aspect of the present invention, after the repositioning step, a fifth step is provided in which the work unit is moved in the operating direction so that the bending device is once again aligned with the at least one metal product being worked, and in which the drawing unit advances in a controlled manner in the direction of feed toward the bending device which performs the workings provided to make at least one last finished product from the at least one metal product.

According to another aspect of the present invention, the method provides a sixth step in which the possible scrap from working is evacuated by the drawing unit or by the work unit.

BRIEF DESCRIPTION OF THE DRAWINGS

These and other aspects, characteristics and advantages of the present invention will become apparent from the following description of some embodiments, given as a non-restrictive example with reference to the attached drawings wherein.

Figure 1:
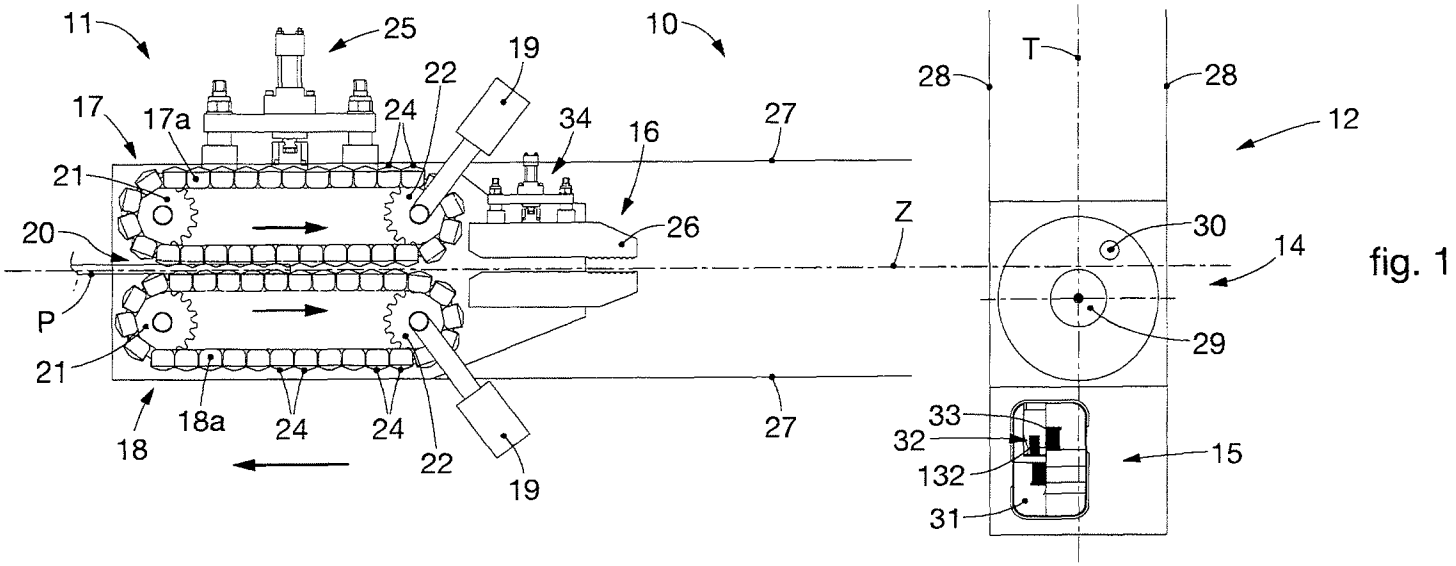
FIGS. 1-8 are lateral views of an apparatus for working oblong metal products in accordance with some embodiments described here and in different operating steps of the corresponding method.
Figure 2:
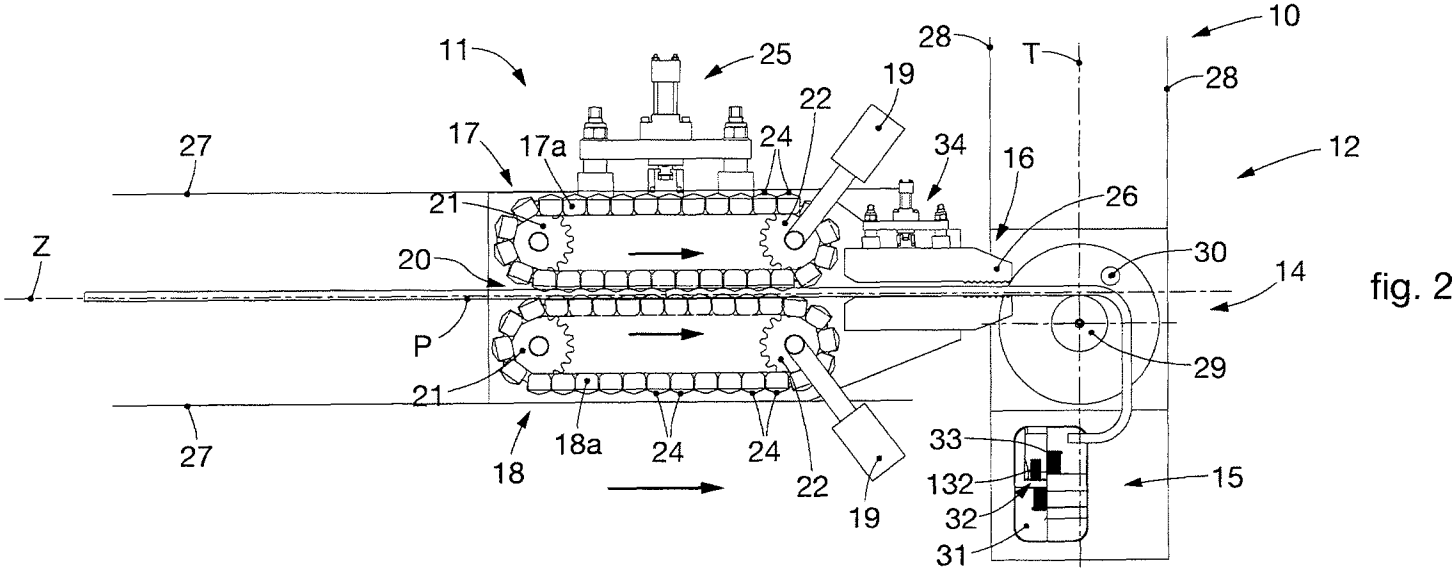

To facilitate comprehension, the same reference numbers have been used, where possible, to identify identical common elements in the drawings. It is understood that elements and characteristics of one embodiment can conveniently be combined or incorporated into other embodiments without further clarifications.

DETAILED DESCRIPTION OF SOME EMBODIMENTS

We will now refer in detail to the various embodiments of the present invention, of which one or more non-limiting examples are shown in the attached drawings. The phraseology and terminology used here is for the purposes of providing non-limiting examples.

Some embodiments described here concern an apparatus 10 for working oblong metal products P comprising at least one drawing unit 11, configured to feed at least one of the metal products P in a direction of feed Z, and a work unit 12 disposed downstream of the drawing unit 11 and comprising a work plane 13 and at least one bending device 14 associated with it.

According to one aspect of the present invention, the work unit 12 comprises a cutting device 15 associated with the work plane 13. The drawing unit 11 is mobile in the direction of feed Z toward/away from the work unit 12 which is mobile in an operating direction T, transverse with respect to the direction of feed Z, so as to dispose on each occasion the bending device 12 or the cutting device 15 aligned with the metal product P being worked.

According to one aspect of the present invention, the drawing unit 11 is associated with gripping means 16 which are operatively facing toward the work unit 12. The gripping means 16 are integral with the drawing unit 11 and move with it, cooperating on each occasion with the bending device 14 or with the cutting device 15.

The movement of the drawing unit 11 in the direction of feed Z coordinated with the action of the gripping means 16 which, as will be better described below, can arrive in very close proximity to the bending device 14, allows to reduce the length of the scrap from working to a minimum.

According to some embodiments, the drawing unit 11 comprises a first dragging member 17 and a second dragging member 18 opposite to each other with respect to the direction of feed Z and at least one motor member 19 for their movement.

The first dragging member 17 and the second dragging member 18 comprise respective tracks 17*a*, 18*a* parallel to each other and defining, between them and in the direction of feed Z, a dragging channel 20 for at least one metal product P.

According to possible embodiments not shown, the dragging members 17, 18 can comprise respective series of shaped rolls, facing each other to define the dragging channel 20.

With particular reference to the example described here, the first dragging member 17 and the second dragging member 18 each comprise a first wheel 21, a second wheel 22, distanced from each other, around which the tracks 17*a*, 18*a* are wound in a closed loop.

The tracks 17*a*, 18*a* define respective first return segments, comprised between the first wheel 21 and the second wheel 22, parallel and opposite the direction of feed Z to define the dragging channel 20 between them.

The dragging channel 20 has a lying plane for the at least one metal product P, and is defined, at the upper and lower parts, by an opposite plurality of anchoring inserts 24 respectively moved by the tracks 17*a*, 18*a*.

The dragging channel 20 can have a width coherent with a multiple of the section of the metal product P, for example to drag more than one of them, and can be adjustable in height by means of positioning and adjustment means 25 that move the first dragging member 17 toward/away from the second dragging member 18, in a direction orthogonal to the direction of feed Z.

According to some embodiments, the gripping means 16 are disposed at the exit of the dragging channel 20 and are advantageously adjustable on a plane substantially orthogonal to the lying plane by means of positioning and adjustment means 34.

The gripping means 16 comprise a gripper 26 able to hold the at least one metal product P at least during the working of its final segment. In particular, the holding action of the gripper 26 is operated with respect to the terminal portion of the metal product P when the latter has completely, or almost completely, exited from the dragging channel 20.

The gripping action of the gripper 26, combined with the advance movement of the drawing unit 11, allows to eliminate the problem relating to the minimum length of metal product P being gripped required by the dragging units 17, 18 to operate the advance of the metal product P. This allows to increase the length of the metal product P that can be worked, and therefore to reduce the scrap and to decrease the working costs.

The gripper 26 has an elongated profile in the direction of feed Z so that, while the drawing unit 11 moves toward the work unit 12, it is possible to hold the at least one metal product P in order to allow its end portions to also be bent. In particular, the gripper 26 acts on a plane substantially parallel to the work plane 13.

According to some embodiments, the bending device 14 is provided with a fixed contrast element 29 and a bending element 30 mobile with respect to the contrast element 29 to determine the bending of the at least one metal product P around the contrast element 29.

The contrast element 29 has a cylindrical body developed around an axis of rotation orthogonal to the work plane 13 and with respect to which the bending element 30 can rotate to determine the desired bends on the metal products P. In particular, during the bending works the lying plane of the metal product P is substantially tangent to the cylindrical vertical wall of the contrast element 29.

According to some embodiments, at least the contrast element 29 can be retracted from the work plane 13 between a work condition and a condition of non-interference, so as to allow both right bends and also of left bends to be carried out on the metal product P.

According to some embodiments, the work plane 13 can be horizontal, sub-vertical or vertical. Preferably, the work plane 13 is inclined by an angle between about 30° and about 50°, normally about 45° in order to facilitate the evacuation, by gravity, of the finished products FP just made.

According to some embodiments, the cutting device 15 is disposed adjacent to the bending device 14, in particular in a position such as not to interfere with the metal product P during the bending works.

For this purpose, the cutting device 15 is retractably mobile with respect to the work plane 13 to assume a retracted position, inside the work plane 13 and not interfering with the metal product P being worked, and a protruding position, outside the work plane 13 in which the cutting device 15 is operative at least to perform the cutting of the metal product P being worked.

According to some embodiments, the cutting device 15 comprises a support 31 retractably mobile with respect to the work plane 13 on which both a shears 33 and also pinching means 32 are present, which, in the case shown in the drawings, consist of a gripper 132 distinct from the shears 33. As mentioned, alternative solutions fall within the scope of the invention, in which the pinching means 32 consist of the shears 33 itself which, based on the position of the cutting element and of the contrast, can perform both cutting functions and also pinching functions, or also in which the pinching means 32 consist partly of components of the shears 33 and partly of elements distinct from the shears 33.

When the bending device 14 is aligned with the metal product P to carry out the bending works, the support 31 can be advantageously disposed in a retracted position in which both the gripper 132 and also the shears 33 are inside the work plane 13.

At the end of the bending works, the work unit 12 is moved so as to align the cutting device 15, in particular the gripper 132 and the shears 33, with the metal product P being worked. In this case, the support 31 is raised in a protruding position so that the gripper 132 and the shears 33 can respectively hold and cut the metal product P being worked, according to requirements.

According to some embodiments, the protruding position which the gripper 132 and the shears 33 are in can be suitably adjusted so that their distance from the work plane 13 is coherent with the size and number of metal products P to be cut. In the example described in FIG. 3*a*, the number of metal products P being worked is two, four metal products are aligned on the shears 33, but the shears 33 simultaneously cuts only two of them at a time. Obviously, the shears 33 can cut even more than two of them at a time, depending on the size of the cutting edges and the quantity of metal products P being worked.

According to possible embodiments, the gripper 132 and the shears 33 can assume respective protruding or retracted positions independently of each other, depending on the need to use one, the other or both.

According to some embodiments, the drawing unit 11 and the work unit 12 are mobile respectively on guides 27, 28 which are parallel to the direction of feed Z and the operating direction T respectively. In the example described here, the operating direction T is orthogonal to the direction of feed Z.

Figure 3A:
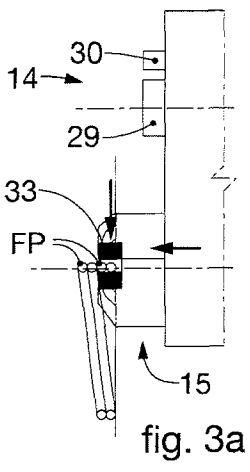
FIG. 3*a* shows an enlarged detail in another lateral view of the cutting device in the operating position in which it finds itself in FIG. 3.
Figure 3:
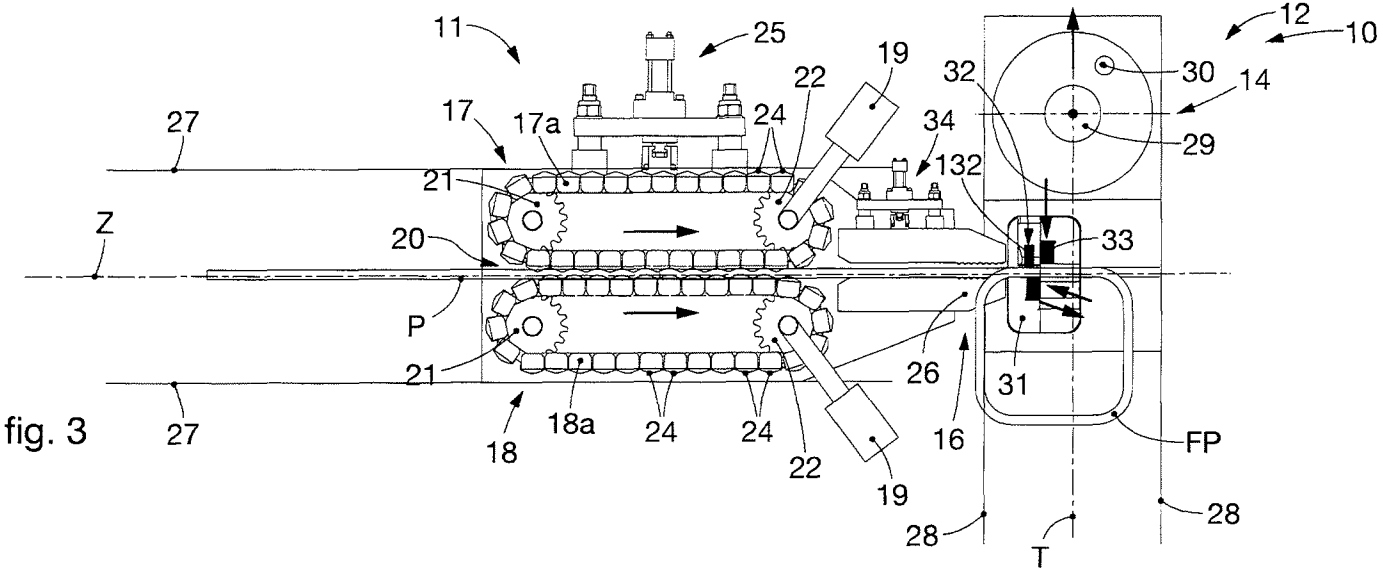

In accordance with some embodiments, shown in FIGS. 1-8, there is provided a method to work oblong metal products P which comprises at least:

- a first step, in which the drawing unit 11 moves backward in the direction of feed Z, away from the work unit 12, to pick up at least one waiting metal product P, which is held between the tracks 17*a*, 18*a* (FIG. 1),
- a second step, in which the drawing unit 11 advances in the direction of feed Z toward the work unit 12 to reach a position where the at least one metal product P is worked, and in which the work unit 12 is moved in the operating direction T so that the bending device 14 is aligned with the at least one metal product P (FIG. 2),
- a third step, in which the drawing unit 11, remaining stationary in the work position, makes the at least one metal product P advance by means of the tracks 17*a*, 18*a* toward the bending device 14 which performs the workings provided in order to make at least one finished product FP (FIG. 2),
- a fourth step, in which the work unit 12 is moved in the operating direction T so that the cutting device 15 is aligned with the at least one metal product P being worked in order to cut off the at least one finished product PF from the at least one metal product P (FIG. 3-3*a*).

In particular, in the third step the cutting device 15 is in a retracted position while in the fourth step the cutting device 15 is in a protruding position in which the cutting device 15 is operative at least to perform the cutting of the at least one metal product P being worked with the shears 33, FIG. 3*a*. Advantageously, during the execution of the cutting operation, the gripper 132 can hold the metal product P in order to guarantee a more precise cut without deformations.

According to one aspect of the present invention, when the length of the at least one metal product P being worked is not sufficient for the latter to be drawn by the tracks 17*a*, 18*a*, the method provides a repositioning step in which the work unit 12 is moved in the operating direction T so that the cutting device 15 is aligned with the at least one metal product P, so that the gripper 132 can hold it. The drawing unit 11 moves backward in the direction of feed Z, away from the work unit 12, so that the end portion, or tail end, of the at least one metal product P is taken in correspondence with the gripping means 16 which are tightened in order to hold the at least one metal product P, FIG. 5.

Figure 4:
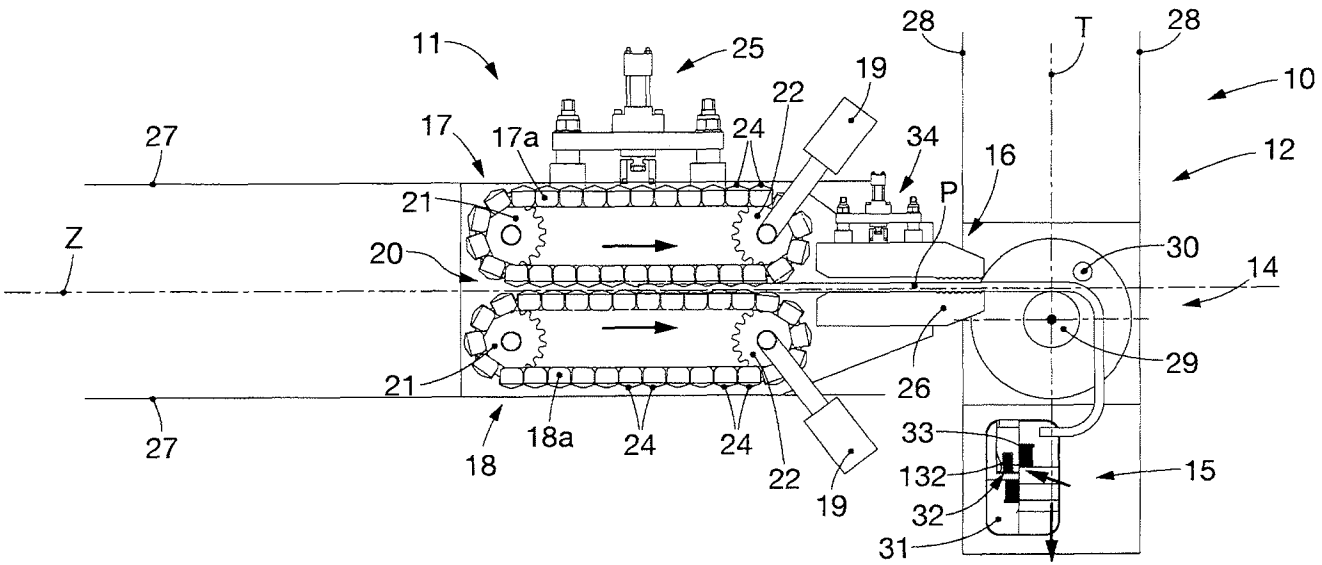
Figure 5:
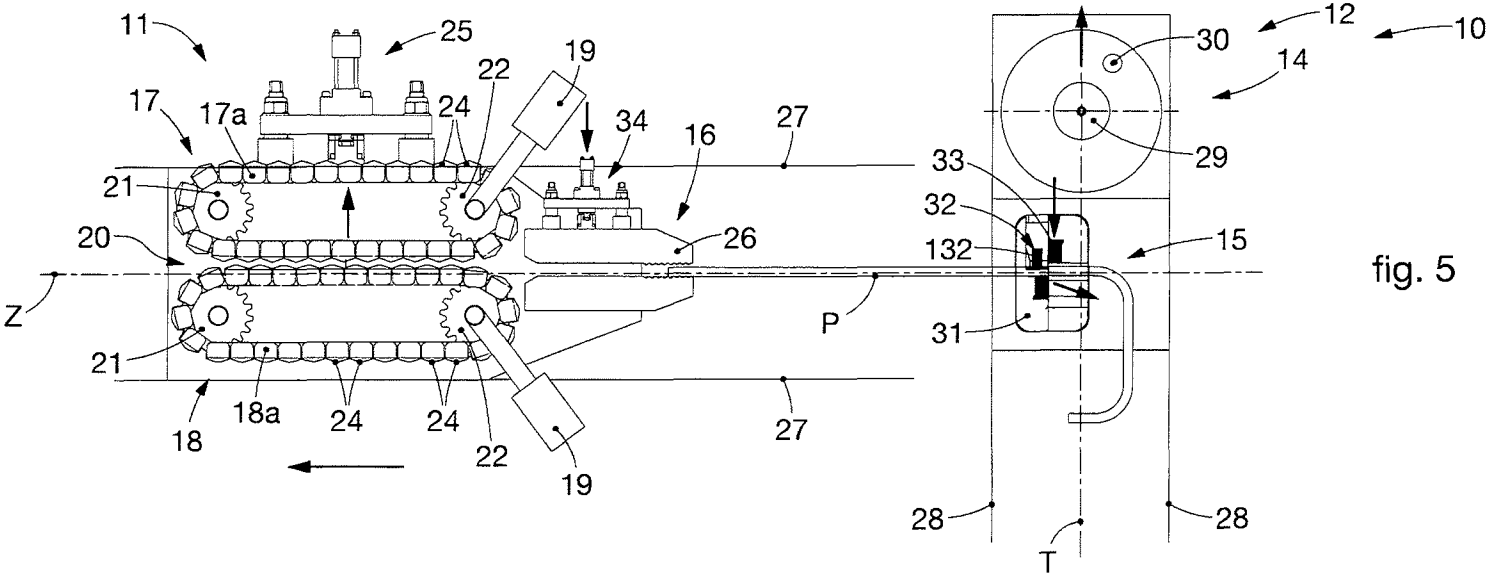

In particular, as shown in FIG. 4, when the tail end of the metal product P is between the tracks 17*a*, 18*a* at an intermediate point between the center to center distance of the first wheels 21 and the second wheels 22, the movement by means of the tracks 17*a*, 18*a* begins to become critical and it is therefore necessary to provide the repositioning step.

Figure 6:
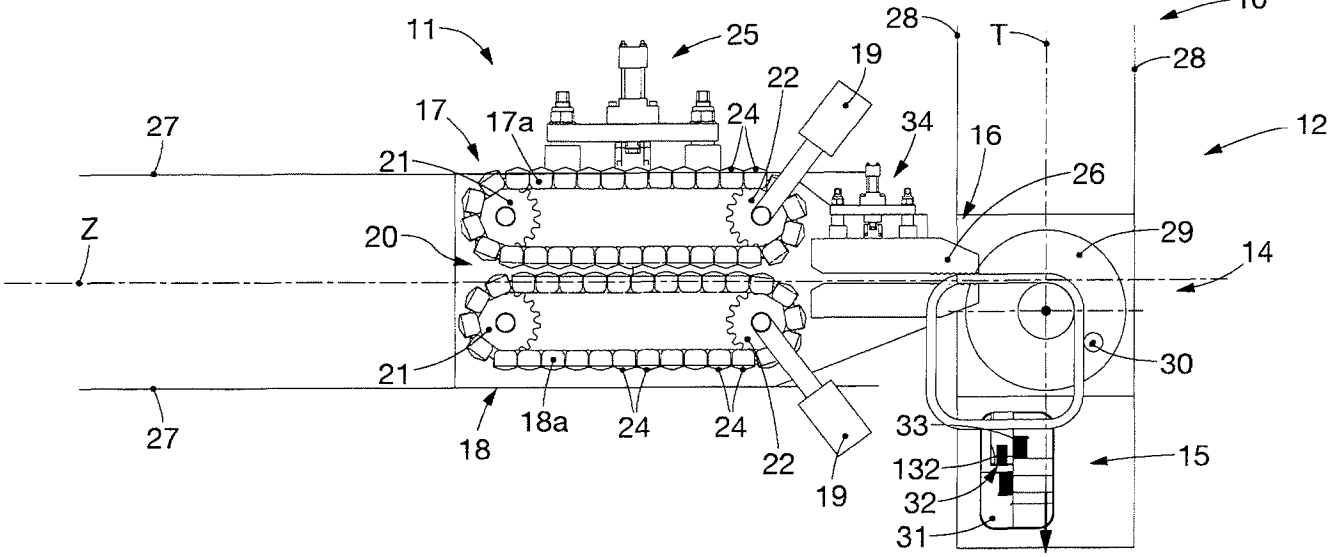
Figure 7:
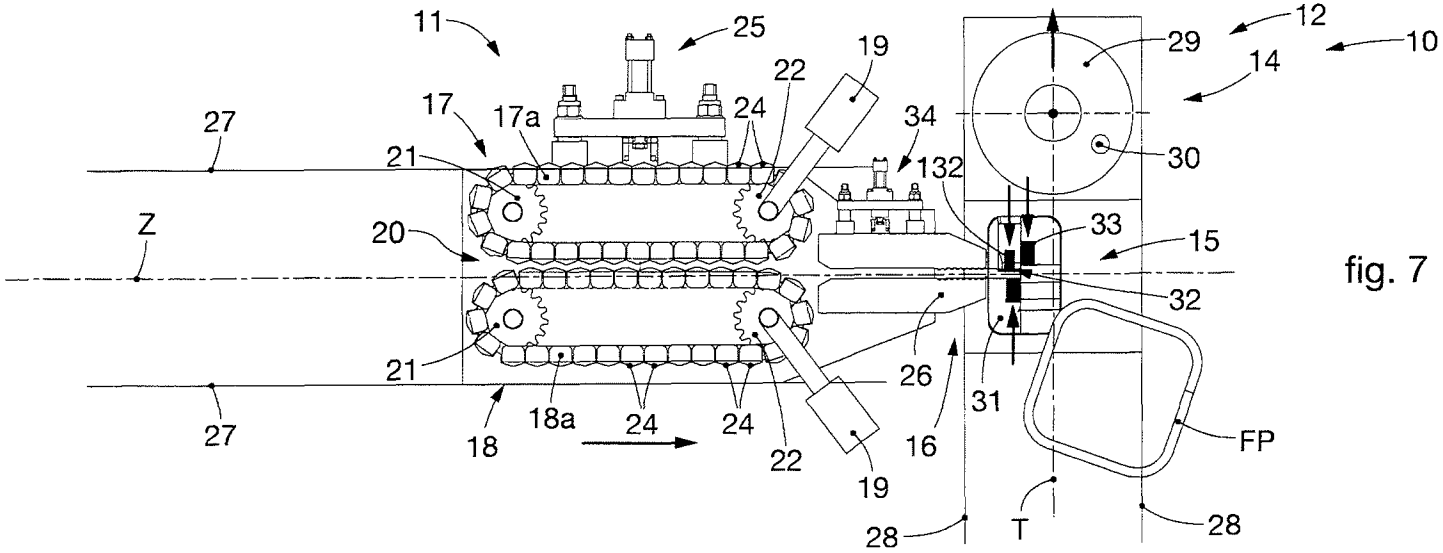

According to one aspect of the present invention, following the repositioning step, a fifth step is provided in which the work unit 12 is moved in the operating direction T so that the bending device 14 is aligned with the at least one metal product P, and in which the drawing unit 11 advances in a controlled manner in the direction of feed Z toward the bending device 14 which performs the workings provided to make at least one last finished product FP of the at least one metal product P, FIGS. 6-7.

Figure 8:
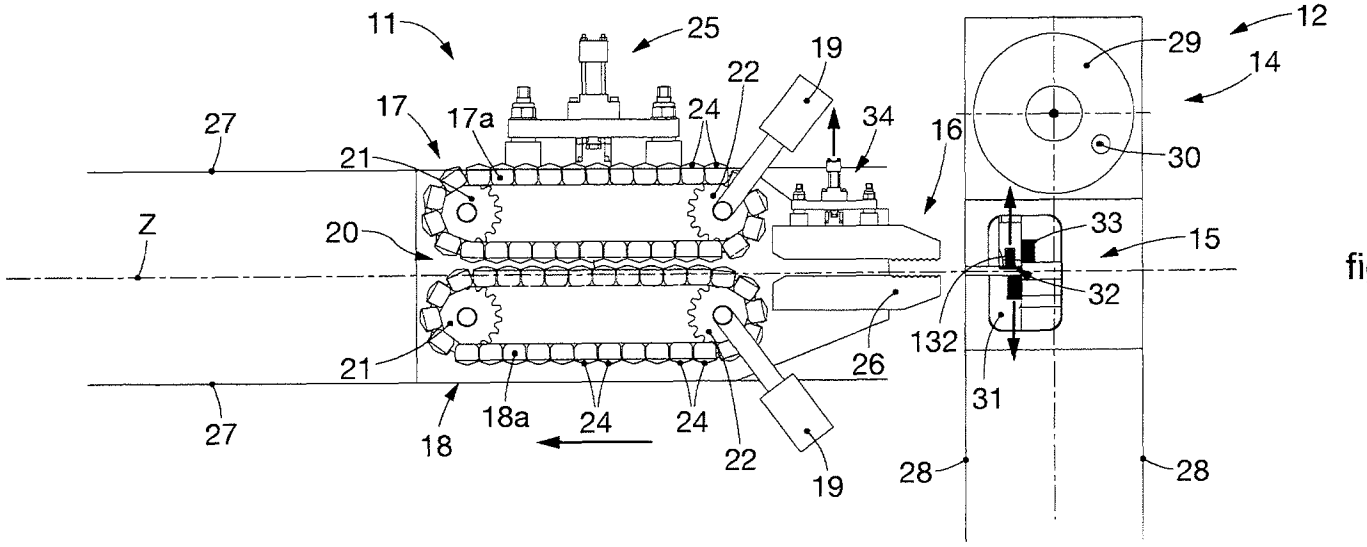

According to one aspect of the present invention, the method provides a sixth step in which the at least one scrap from working is evacuated from the drawing unit 11 or from the work unit 12, FIG. 8. For example, the scrap from working 12 can remain blocked in the gripper 132 and be evacuated by gravity, or it can remain blocked in the gripper 26 and be evacuated by the thrust of the subsequent metal product P.

It is clear that modifications and/or additions of parts or steps may be made to the apparatus 10 and to the method for working oblong metal products P as described heretofore, without departing from the field and scope of the present invention as defined by the claims.

In the following claims, the sole purpose of the references in brackets is to facilitate reading: they must not be considered as restrictive factors with regard to the field of protection claimed in the specific claims.

What is claimed is:

1. An apparatus configured for working oblong metal products to obtain finished products, the apparatus comprising:

a drawing unit configured to move a metal product (P) in a direction of feed (Z); and a work unit disposed downstream of said drawing unit, said work unit comprising a work plane with which a bending device and a cutting device are associated;

wherein said drawing unit is mobile in the direction of feed (Z) toward and away from said work unit, and said work unit is mobile in an operating direction (T) that is transverse to said direction of feed (Z); and wherein the cutting device is offset from the bending device in the operating direction (T), such that movement of the work unit in the operating direction (T) enables alignment of either the bending device or, alternatively, the cutting device with the direction of feed (Z) without simultaneous alignment of both the bending device and the cutting device with the direction of feed (Z).

2. The apparatus of claim 1, wherein said drawing unit comprises dragging members provided with respective tracks, said drawing unit being associated with a gripping device facing toward said work unit and comprising a gripper that has an elongated profile in the direction of feed (Z) and is able to hold said at least one metal product (P) at least during a working of a final portion thereof.

3. The apparatus of claim 1, wherein said cutting device comprises at least one of a pinching device having a pinching function and a shears.

4. The apparatus of claim 1, wherein said cutting device comprises a pinching device having a pinching function, said pinching device being also a shears.

5. The apparatus of claim 1, wherein said cutting device comprises a pinching device having a pinching function that is a gripper, and a shears that is distinct from the pinching device.

6. The apparatus of claim 3, wherein the pinching device having a pinching function comprises at least a first portion that is part of the shears and a second portion that is distinct from the shears.

7. The apparatus of claim 1, wherein said cutting device is retractably mobile between a retracted position and a position protruding with respect to said work plane, said cutting device in said protruding position being operative to perform gripping and/or cutting of said at least one metal product (P) being worked.

8. The apparatus of claim 7, wherein said cutting device comprises at least one shears and a pinching device having a pinching function, and wherein when the cutting device is in the protruding position, locations of said pinching device having a pinching function and said shears are adjustable with respect to said work plane.

9. The apparatus of claim 1, wherein said drawing unit and said work unit are mobile respectively on guides which are parallel respectively to said direction of feed (Z) and to said operating direction (T), and wherein said operating direction (T) is orthogonal to said direction of feed (Z).

10. A method of working oblong metal products (P) t comprising:

providing an apparatus comprising:

a drawing unit configured to move at least one of said metal products (P) in a direction of feed (Z), said drawing unit comprising dragging members provided with respective tracks; and a work unit disposed downstream of said drawing unit, said work unit comprising a work plane with which a bending device and a cutting device are associated;

wherein said drawing unit is mobile in a direction of feed (Z) toward/away from said work unit, and said work unit is mobile in an operating direction (T) that is transverse to said direction of feed (Z); and wherein the cutting device is offset from the bending device in the operating direction (T), such that movement of the work unit in the operating direction (T) enables alignment of either the bending device, or alternatively, the cutting device with the direction of feed (Z), without simultaneous alignment of both the bending device and the cutting device with the direction of feed (Z);

in a first step, moving the drawing unit backward in the direction of feed (Z), away from said work unit, and picking up by the drawing unit of at least one waiting metal product (P);

in a second step advancing said drawing unit in the direction of feed (Z) toward said work unit to reach a work position where said at least one metal product (P) can be worked, and moving said work unit in said operating direction (T) so that said bending device is aligned with said at least one metal product (P);

in a third step, while the drawing unit, remains stationary in the work position, advancing said at least one metal product (P) by said drawing unit by means of said dragging members toward said bending device, and performing by the bending device of workings to produce at least one first finished product; and in a fourth step, moving said work unit in said operating direction (T) so that said cutting device is aligned with said at least one metal product (P), and cutting and partly moving said at least one first finished product away from said at least one metal product (P).

11. The method of claim 10, wherein:

said cutting device comprises at least one shears;

in said third step said cutting device is in a retracted position inside the work plane and not interfering with the at least one metal product (P) being worked; and in said fourth step said cutting device is in a protruding position, outside said work plane in which said cutting device is operative, at least to perform the cutting of said at least one metal product (P) being worked with the shears.

12. The method of claim 10, wherein the cutting device includes a pinching device having a pinching function, and wherein if the length of the at least one metal product (P) being worked is not sufficient for said at least one metal product (P) to be drawn by the dragging members, said method further includes a repositioning step in which said work unit is moved in said operating direction (T) so that said cutting device is aligned with said at least one metal product (P) being worked in order to hold said at least one metal product (P) with the pinching device having a pinching function, and in which said drawing unit moves backward in the direction of feed (Z), away from said work unit, so that a tail end of the at least one metal product (P) is taken in correspondence with a gripping device that is tightened in order to hold said at least one metal product (P).

13. The method of claim 12, further comprising, after said repositioning step, a fifth step in which said work unit is moved in said operating direction (T) so that said bending device is aligned with said at least one metal product (P), and in which said drawing unit advances in a controlled manner in the direction of feed (Z) toward said bending device, which performs the workings to make at least one last finished product of said at least one metal product (P).

14. The method of claim 13, further comprising a sixth step in which scrap resulting from the workings is vacuumed away by said drawing unit or by said work unit.

* * * * *